United States Patent [19]

Bell

[11] Patent Number: 4,896,821

[45] Date of Patent: Jan. 30, 1990

[54] ENVELOPES

[75] Inventor: Laurence J. Bell, Victoria, Australia

[73] Assignee: Envelopments Pty. Ltd., Melbourne, Australia

[21] Appl. No.: 67,644

[22] Filed: Jun. 26, 1987

[51] Int. Cl.[4] ..... B65D 27/10

[52] U.S. Cl. ..... 229/69; 229/68 R

[58] Field of Search ..... 229/69, 68 R

[56] References Cited

U.S. PATENT DOCUMENTS

| | | | |
|---|---|---|---|
| 3,547,343 | 12/1970 | Alton | 229/69 |
| 3,790,068 | 2/1974 | Stutz | 229/69 |
| 4,084,741 | 4/1978 | Heimann | 229/69 |

FOREIGN PATENT DOCUMENTS

| | | | |
|---|---|---|---|
| 0134151 | 3/1985 | European Pat. Off. . | |
| 567924 | 6/1944 | United Kingdom | 229/69 |
| 757151 | 7/1954 | United Kingdom | 229/69 |

*Primary Examiner*—Willis Little

*Attorney, Agent, or Firm*—Scully, Scott, Murphy & Presser

[57] ABSTRACT

An article of stationery comprising a continuous length of paper or other material suitable for envelope formation folded to define a plurality of envelopes. Each envelope, except that one at one end of the length, partly overlaps and is attached to a first adjacent envelope and, except that one at the other end of the length, is partly overlapped by and is attached to another, second adjacent envelope. Each envelope comprises a face and a back, and at least substantially the whole of the face of each envelope is not overlapped by an adjacent envelope.

46 Claims, 19 Drawing Sheets

ENVELOPES

Figure 1:
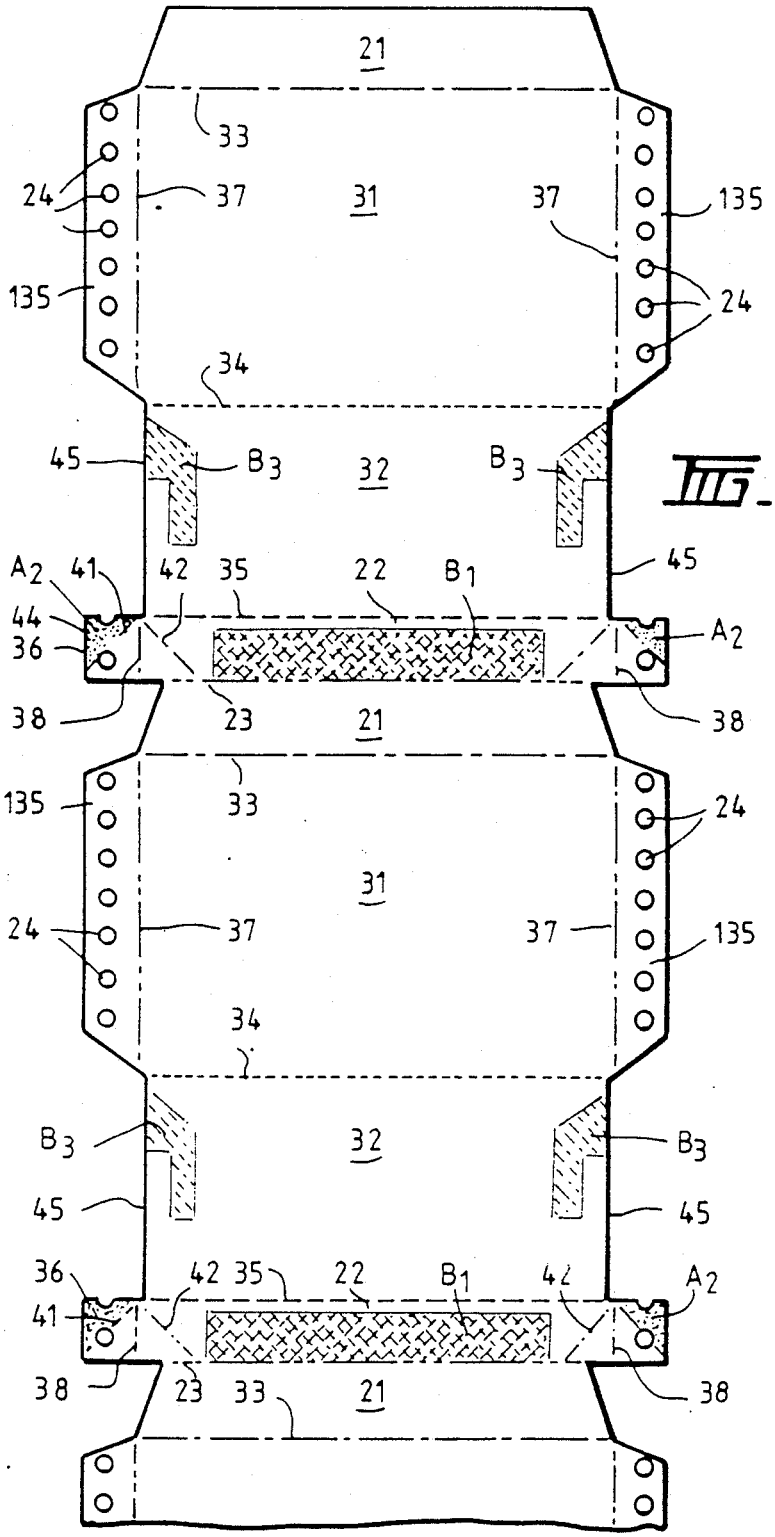

This invention relates to an article of stationery and in a particular aspect relates to envelopes.

In a particularly preferred instance the present invention provides an article of stationery comprising a length of paper or other material suitable for envelope formation folded to define a plurality of envelopes wherein each envelope, excepting that one at one of the length, partly overlaps and is attached to an adjacent envelope and, excepting that one at the other end of the length, is partly overlapped by and is attached to another adjacent envelope.

Preferably, each envelope comprises a face and a back and wherein attached to the face is a first seal tab adapted to be folded to the rear of the envelope to seal the envelope.

Preferably attached to the back is a second seal tab over which the first seal tab may be folded to seal the envelope.

Preferably, the sum of twice the length of the first tab and the length of the second tab, is not greater than the length of the face of the envelope plus not have more than 10 mm.

Preferably, the first tab of each envelope is joined to the face of the envelope via a line, real, imaginary or of preferential folding, and the back of the envelope, at least adjacent the side edges thereof, extends substantially to that line.

Preferably one or both of the first seal tab and the second seal tab is provided with an adhesive. That adhesive may be a moisture activatable adhesive but more preferablyis a pressure-sensitive adhesive.

The second seal tab of one envelope is preferably attached to the first seal tab of the adjacent envelope so that the face of said one envelope overlaps the face of said adjacent envelope. That attachment is preferably via a line of preferential tearing along which the envelopes may be separated.

The second seal tab of each envelope is preferably folded to be overlapped by the back of the respective envelope and will need to be unfolded to sealingly engage with the first seal tab.

The second seal tab or an extension thereof is preferably so connected to the side edges of the respective envelope to cause folding of those side edges to overlap the back when the second seal tab is unfolded as aforesaid. Such folding of said side edges may be facilitated by lines of preferential folding spaced from said side edges and in the second seal tab or said extension.

To retain said side edges in such folded condition they and/or the back may be provided with an adhesive.

Said side edges may conveniently be provided with sprocket holes for use with sprocket fed printers.

Preferably, such perforations, and/or lines of preferential bending which extend across the side edges either do not extend in lines which pass through the sprocket holes or extend in lines which pass through substantially the centre of a sprocket hole.

The face and back of each envelope may or may not be completely secured to one another along said side edges.

In one instance said side edges are attached to the envelopes via a line of preferential tearing whereby said side edges may be stripped from the envelopes.

In one instance the face and back of each envelope are bonded together inboard of said side edges.

Preferably, the face and back of each envelope are not secured together in a region along their side edges whereby to permit air entrapped in each envelope in passing through a mechanism to escape.

Two or more such articles of stationery may be arranged in side-by-side relation to produce a composite article having two or more envelopes across its width.

Articles of stationery in accordance with this invention may be in single sheet form or continuous form.

In one instance, the article of stationery is in fanfold form.

Preferably there are lines or preferential folding in certain ones of said envelopes to facilitate said fan folding.

Preferably the lines of preferential folding to facilitate such fanfolding pass only through the face of the respective envelopes and not also through the back of the respective envelopes.

Preferably said lines of preferential folding to facilitate such fanfolding pass through the face of the respective envelopes intermediate the first seal tab and the back of the respective envelopes.

Preferably in no region of said article of stationery is more than three layers thick of said paper or other material suitable for envelope formation.

Preferably, the article the stationery is, at least substantially inboard of side edges of each envelope and notwithstanding the overlap of adjacent envelopes, not more than three layers thick of said paper or other material suitable for envelope formation.

Preferably, the article of stationery is, adjacent side edges of each envelope, and not withstanding the overlap of adjacent envelopes, not more than four layers thick of said paper or other material suitable for envelope formation.

Preferably, the article of stationery substantially inboard of side edges of each envelope is less than three layers thick of said paper or other material suitable for envelope formation in regions along its length; and preferably said regions are not more than 50 mm in length, more preferably said regions are not more than 40 mm in length, and even more preferably said regions are not more that 30 mm in length.

In one embodiment, the article of stationery adjacent side edges of each envelope is less than four layers thick of said paper or other material suitable for envelope formation in regions along its length; and preferably these regions are not more than 10 mm in length, and even more preferably these regions are not more than five mm in length.

In one embodiment, the article of stationery substantially inboard of side edges of each envelope is preferably of a substantially constant thickness of three layers thick of said paper or other material suitable for envelope formation throughout its length, or throughout at least 70% of the length of the article of stationery.

In one embodiment, the article of stationery adjacent side edges of each envelope is of a substantially constant thickness of four layers of said paper or other material suitable for envelope formation throughout its length, or at least throughout 90% of its length.

In one instance there is a second set of sprocket holes in said side edges outboard of the first mentioned sprocket holes.

Preferably said second set of sprocket holes is spaced from the first mentioned sprocket holes by a region having a line of preferential tearing whereby that part of the side edges having said second set of sprocket holes may be stripped from the envelopes.

Preferably in the regions of said articles of stationery in which part of one envelope overlaps part of another, adjacent, envelope the side edges of, respectively, the overlapping envelope or the overlapped envelope in way of the sprocket holes therein extend relatively more laterally than, respectively, the side edges of the overlapped envelope or the overlapping envelope whereby, in use, a sprocket feed mechanism will engage with sprocket holes in the parts of the side edges which extend relatively more laterally and not with, respectively, the side edges of the overlapped envelope or the overlapping envelope.

Preferably, adjacent envelopes are attached to one another via a line of preferential tearing whereby said article of stationery may be separated into individual envelopes unattached to one another.

In one instance, the article of stationery may include a backing sheet.

In one instance, the article of stationery may include a facing sheet.

The facing sheet may have apertures through which type or other indicia may be applied to the face of each envelope.

In another instance, the facing sheet may be such that when type or other indicia is applied thereto in a region a representation of that type or other indicia will appear on the face of the envelope therebelow.

Figure 2:
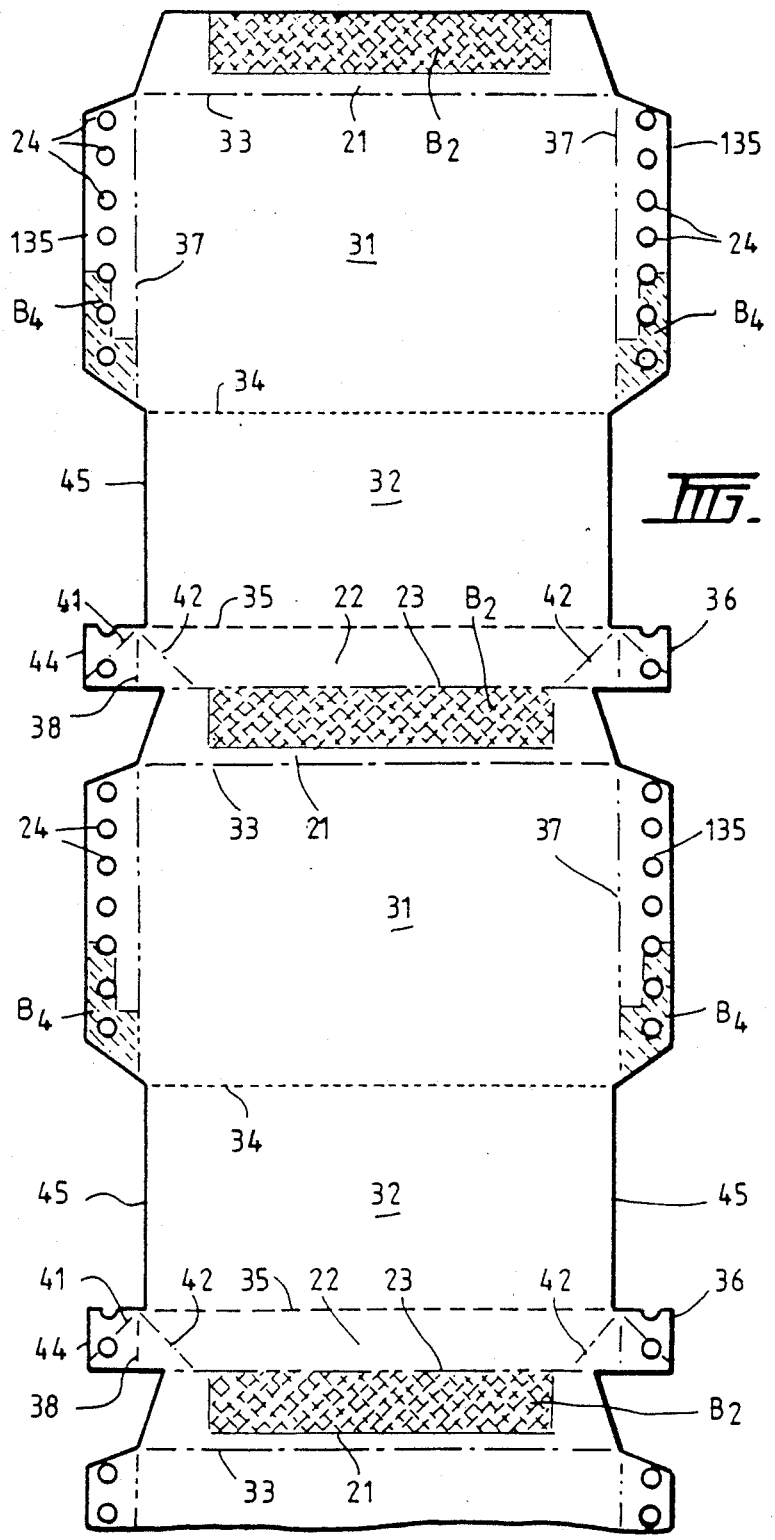
Figure 3:
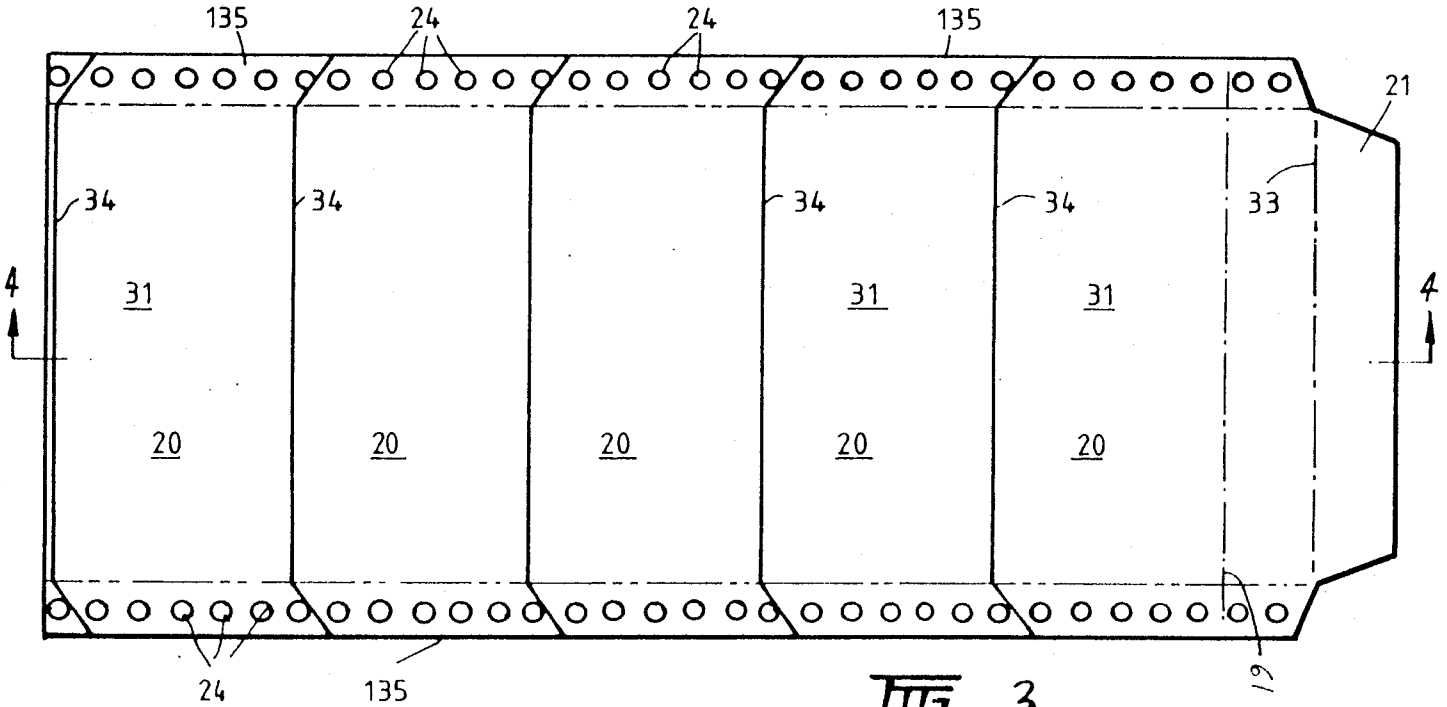
Figure 4:
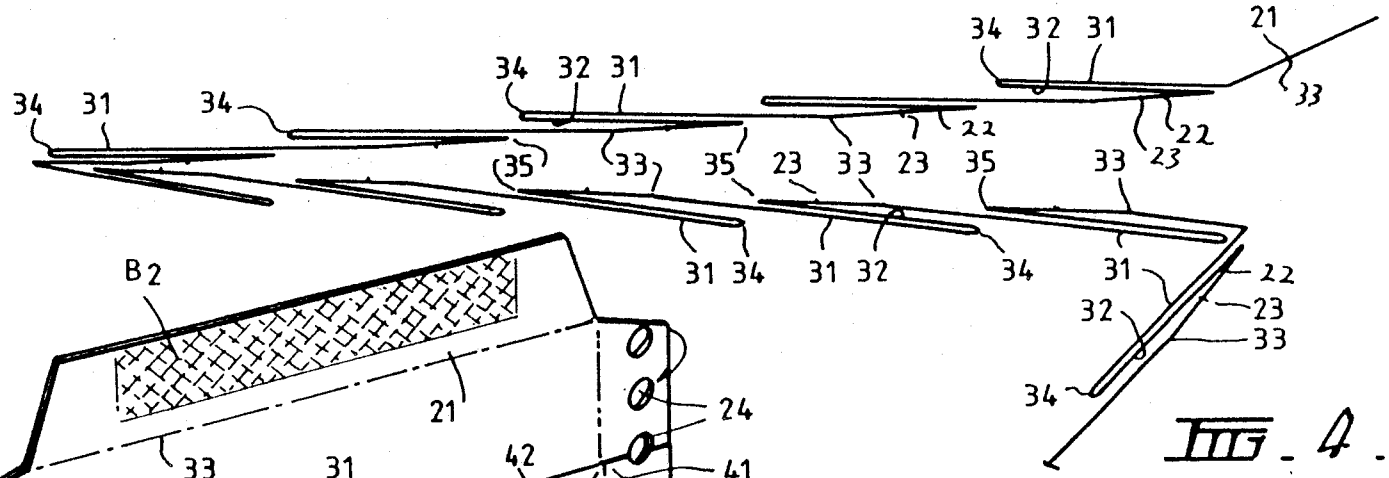
Figure 5:
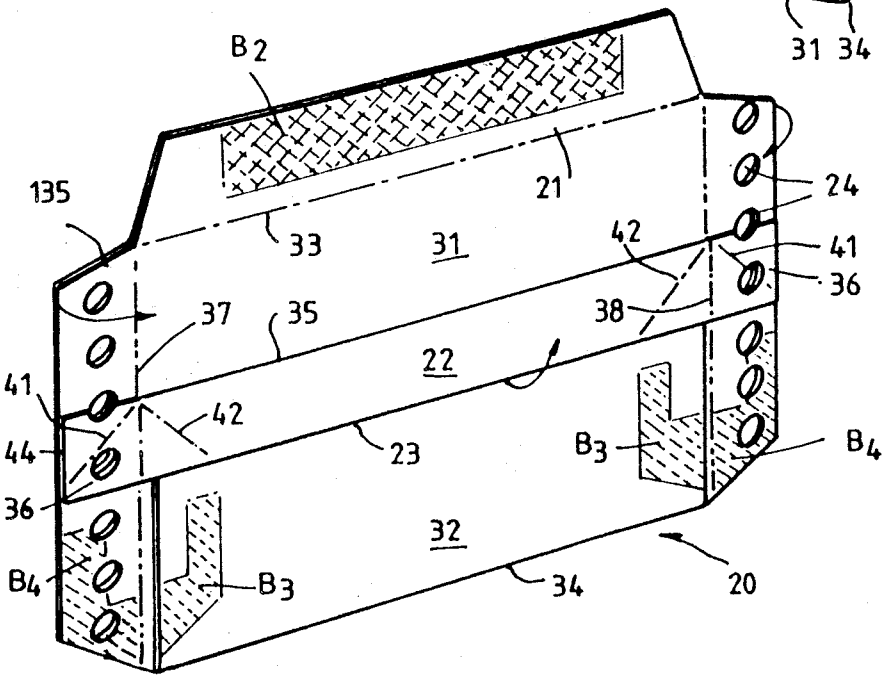

Specific constructions of articles of stationery in accordance with this invention will now be described with the aid of the accompanying drawings in which:

FIG. 1 is a plan view from one side of a sheet of paper used to form an article of stationery in accordance with this invention, which article being shown in FIG. 3, FIG. 2 is a plan view from the opposite side of the sheet of FIG. 1, FIG. 3 is the article of stationery fromed by folding the sheet shown in FIGS. 1 and 2, FIG. 4 is a cross-section on line 4—4 in FIG. 3, FIG. 5 is a perspective view of an individual envelope separated from the article of stationery shown in FIG. 3, FIG. 6 is a view corresponding to FIG. 5 but showing the envelope in partly folded condition, FIG. 7 is a view corresponding to FIG. 5 but showing the envelope in partly folded condition, FIG. 8 is a view corresponding to FIG. 5 but showing the envelope in fully folded condition, FIG. 9 is a modified version of the sheet of paper of FIG. 1, FIG. 10 is a view corresponding to FIG. 2 but of a modified sheet, FIG. 11 is a plan view from one side of a sheet of paper used to form an article of stationery in accordance with this invention, which article being shown in FIGS. 13–17, FIG. 12 is a plan view from the opposite side of the sheet of FIG. 11, FIG. 13 is the article of stationery formed by folding the sheet shown in FIGS. 11 and 12 but showing it during formation and with parts omitted for clarity, FIG. 14 is the article of stationery formed by folding the sheet shown in FIGS. 11 and 12 but showing it during formation and with parts omitted for clarity, FIG. 15 is the article of stationery formed by folding the sheet shown in FIGS. 11 and 12, FIG. 16 is the article of stationery formed by folding the sheet shown in FIGS. 11 and 12 but partially in cross-section, FIG. 17 is the article of stationery formed by folding the sheet shown in FIGS. 11 and 12 but partially in cross-section, FIG. 18 is a plan view from one side of a sheet of paper used to form an article of stationery in accordance with this invention, which article being shown in FIGS. 20–23, FIG. 19 is a plan view from the opposite side of the sheet of FIG. 18, FIG. 20 is the article of stationery formed by folding the sheet shown in FIGS. 18 and 19 but showing it during formation and with parts omitted for clarity, FIG. 21 is the article of stationery formed by folding the sheet shown in FIGS. 18 and 19, FIG. 22 is the article of stationery formed by folding the sheet shown in FIGS. 18 and 19 and in fanfold form view from one side, and FIG. 23 is the article of stationery formed by folding the sheet shown in FIGS. 18 and 19 and in fanfold view from other side.

Legend

To facilitate understanding of the accompanying drawings and in particular FIGS. 1 and 2, the following legend has been used:

(a) Long dash-2 short dash-long dash. This indicates a line of perforations.

(b) Short dashes. This indicates a fold line which is present in the article of stationery.

(c) Long dash-short-dash-long dash. This indicates a fold to be made in use.

(d) Long dashes. This indicates a fold line which is present in the article of stationery but which is to be unfolded in use.

(e) Stipple hatching. This represents adhesive type A.

(f) Cross-hatching. This represents adhesive type B or type C.

(g) Oblique dash hatching. This represents adhesive type B.

The article of stationery shown in FIGS. 3 and 4 comprises a plurality of envelopes 20 in fanfold form which are attached to one another by a first seal tab 21 at the top of each envelope being attached to a second seal tab 22 at the back of each envelope via a perforated tear line 23.

The sides of each of the envelopes has sprocket holes 24 to enable the article to pass through a sprocket feed printer.

The form of each envelope 20 will be better understood from FIG. 5 and FIGS. 1 and 2.

Referring to FIG. 5 and FIGS. 1 and 2 each individual envelope 20 was formed with others by folding a sheet.

The sheet may be considered to have a front, as shown in FIG. 1 on which the face 31 and rear 32 of each envelope is uppermost and a back, as shown in FIG. 2 on which the face 31 and rear 32 of each envelope is downward.

The sheet is provided with a line of preferential folding 33 for the first said tab 21, lines 34 and 35 on which the sheet is actually folded to form each individual envelope and in respect of line 35 to be unfolded in use to erect the second seal tab 22 for sealing with the first seal tab 21 and the perforated tear line 23.

In addition, the sheet has side flaps 135 and 36 defined by perforated lines 37 and 38. In a modification lines 37 and 38 are lines of preferential folding.

The side flaps 36 and the second seal tab 22 have lines of preferential folding 41 and 42.

Adhesive of type A is applied to regions A2 on the side flap 36 (defined by line 35, side edges 44 and line 41).

Adhesive of type B is applied to regions B1 (second seal tab 22), B2 (first seal tab 21), B3 (adjacent side edge 45), and B4 (side flaps 135).

Alternatively adhesive of type C may be applied to one of areas B1 and B2 and no adhesive is applied to the other of areas B1 and B2.

Adhesive of type A is intended to bond parts of the envelopes together after folding to form the article shown in FIG. 3 and in this respect areas A2 are brought into juxtaposition with the side flaps 135 to bond them by folding on lines 35.

Adhesive of types B and C are intended to bond parts of the envelope together after printing and separation from the article for sealing and dispatch to an addressee.

Adhesive of types A, B and C may be one and the same if desired by may alternatively be different.

The sheet shown in FIGS. 1 and 2 is folded and bonded and aforesaid to form the article of FIG. 3.

To enable the article of stationery shown in FIG. 3 to be in fanfold form each nth envelope is provided with a line of preferential folding 61 where "n" is the number of envelopes to be in each fold of the fanfold form. A convenient value for "n" is 5.

The article of FIG. 3 can pass through printers to print addresses and after printing the individual envelopes may be separated by tearing on lines 23 to form the individual envelopes such as shown in FIG. 5.

After separation of the envelopes the second seal tabs 22 are unfolded as indicated in FIGS. 6–8 and in so doing the side flap 135 will be caused to overlie the side edges 45 which are otherwise unbonded so that the adhesive areas B3 and B4 contact and bond. Thereafter, the first seal tab 21 can be folded over the second seal tab 22 and the adhesive areas B1 and B2 can bond.

An alternative way of using the article shown in FIG. 3 is to strip the side flaps 135 and 36 from the article on perforation lines 37 and 38. However, if this is intended to be done then the adhesive areas B3 and B4 should be located as shown in FIG. 10.

It is to be noted that the adhesive in areas B3 and B4 in FIGS. 1 and 2 and in FIG. 10 do not extend to line 34 so as to allow a slight gap for escape of air which may be entrapped in passing through pinch rollers such as of a printer.

The modification shown in FIG. 9 has additional sprocket holes in side edges 235 which may be separated on perforated lines 237. These additional sprocket holes may be found useful in the actual manufacture of the sheet shown in FIG. 9.

The article of stationery shown in FIGS. 13–17 and the sheet of paper shown in FIGS. 11 and 12 are similar to those shown in FIGS. 3 and 4 and 1 and 2 and like reference numerals denot like parts.

The following significant modifications are however to be noted.

Adhesive areas B1, B3 and B4 are omitted.

Adhesive area B5 is provided and may be of a re-moistenable type or pressure sensitive type. The purpose of this is, in the finished envelope, to secure the second seal tab 22 to the rear 32 to provide additional strength to the envelope particularly in the region of fold line 35 and may be required to enable the envelope to be used by a machine for placing a letter or other material into the envelope. In this modification the adhesive area B2, which may be a re-moistenable (FIGS. 14 and 16) or pressure sensitive (FIGS. 13 and 17) adhesive will be used to seal the envelope by bonding that side of the first seal tab 21 seen in FIG. 12 to that side of the second seal tab 22 seen in FIG. 12.

The side flap regions 36 and the associated adhesive areas A2 are omitted.

The rear 32 is provided with side flaps 235 which are provided with adhesive regions A3. In formation of an envelope, the side flaps 235 are folded along fold lines 145 so as to locate against and be secured to the inside of the face 31 of the envelope that is the sides of the flaps 235 seen in FIG. 11 are secured to the side of the face 31 seen in FIG. 12. This is illustrated in FIG. 13. The thus formed envelope (see FIG. 15) will be seen apart from the side flaps 135 and sprocket holes, to be "like" a conventional envelope and if the line 37 is a line of perforations those side flaps 135 may be stripped away.

Adhesive is provided in area A4 on the side flaps 135 and in use will secure the side flaps 135 to the next adjacent envelope by bonding to the upper end (with respect to FIG. 11) of that side of flaps 135 seen in FIG. 11 of the next adjacent envelope. This is illustrated in FIGS. 22 and 23 with respect to FIGS. 18 and 19.

The length of the first seal tab 21, second seal tab 22, face 31 and rear 32 as viewed down the page with respect to FIG. 11 has been changed to facilitate fanfolding. These "lengths" also apply to FIGS. 18 and 19 and will be explained in connection therewith.

The envelope shown in FIG. 21 and similar to that of FIG. 15 and the sheet from which it is made shown in FIGS. 18 and 19 is similar to the sheet shown in FIGS. 11 and 12.

With respect to FIGS. 18 and 19, adhesive areas are not shown and certain lines are not referenced for reasons of ease of depiction.

The following significant modifications are to be noted as compared to FIGS. 18, 19 and 15.

The side flaps 235 of FIGS. 11 and 12 are shown as 335 in FIGS. 18 and 19 and have a somewhat different shape.

The rear 32 of the envelope extends as "extensions" 132 beyond the fold line 35 to terminate on an extension of the line 23. The extensions 132 will give additional strength to the envelope.

The length of the first seal tab 21, second seal tab 22, front 31 and rear 32 are, as discussed with respect to FIGS. 11 and 12, different to the lengths shown in FIGS. 1 and 2. The lengths have been changed so that the line 33 may be used as a fanfold line as shown in FIGS. 22 and 23 and in consequence each envelope prior to fanfolding only overlaps part of the first seal tab 21 of the next adjacent envelope and does not overlap the face of the next adjacent envelope.

The claims form part of the disclosure of the specification.

What is claimed is:

1. An article of stationery comprising a continuous length of paper or other material suitable for envelope formation folded to define a plurality of envelopes wherein each envelope, excepting that one at one end of the length, partly overlaps and is attached, per the continuity of said length, to a first adjacent envelope and, excepting that one at the other end of the length, is partly overlapped by and is attached, per the continuity of said length, to another, second, adjacent envelope and wherein each envelope comprises a face and a back wherein at least substantially the whole of the face of each envelope is not overlapped by an adjacent envelope, wherein said article of stationery is, at least substantially throughout the whole of its length and, at least substantially inboard of side edges of each envelope and notwithstanding such overlap, not more than 3 layers thick of said paper or other material suitable for envelope formation, wherein the envelopes have back side edges extending from the sides of the backs of the envelopes and integral therewith which are folded inwardly and secured to the inside of the front whereby to close the sides of the envelopes, the envelopes further have front side edges integral with the fronts of the envelopes and extending laterally outwardly of the envelopes and provided with sprocket holes for use with sprocket feed printers, wherein said front side edges are attached to the envelopes via a line of perferential tearing whereby said front side edges may be stripped from the envelope, and wherein said line of perferential tearing is located laterally outboard of the sides of the back of the envelopes.

2. An article of stationery as claimed in claim 1, wherein said article of stationery is, adjacent side edges of each envelope, and notwithstanding such overlap, not more than 4 layers thick of said paper or other material suitable for envelope formation.

3. An article of stationery as claimed in claim 1, wherein said article of stationery substantially inboard of side edges of each envelope is less than 3 layers thick of said paper or other material suitable for envelope formation in regions along its length and wherein said regions are not more than 50 mm in length.

4. An article of stationery as claimed in claim 3, wherein said regions are not more than 40 mm in length.

5. An article of stationery as claimed in claim 3, wherein said regions are not more than 30 mm in length.

6. An article of stationery as claimed in claim 1, wherein said article of stationery adjacent side edges of each envelope is less than 4 layers thick of said paper or other material suitable for envelope formation in regions along its length and wherein said regions are not more than 30 mm in length.

7. An article of stationery as claimed in claim 6, wherein said regions are not more than 10 mm in length.

8. An article of stationery as claimed in claim 6, wherein said regions are not more than 5 mm in length

9. An article of stationery as claimed in claim 1, wherein said article of stationery substantially inboard of side edges of each envelope is of a substantially constant thickness of 3 layers thick of said paper or other material suitable for envelope formation throughout its length.

10. An article of stationery as claimed in claim 1, wherein said article of stationery substantially inboard of side edges of each envelope is of constant thickness of 2 layers thick of said paper or other material suitable for envelope formation throughout at least 70% of its length.

11. An article of stationery as claimed in claim 1, wherein said article of stationery adjacent side edges of each envelope is of a substantially constant thickness of 4 layers of said paper or other material suitable for envelope formation throughout its length.

12. An article of stationery as claimed in claim 1, wherein said article of stationery adjacent side edges of each envelope is of constant thickness of 4 layers of said paper or other material suitable for envelope formation throughout at least 90% of its length.

13. An article of stationery as claimed in claim 1, wherein attached to the face of each envelope, per the continuity of said length, is a first tab adapted to be folded to the rear of the envelope to seal the envelope.

14. An article of stationery as claimed in claim 13, wherein the first tab is joined to the face via a line, real, imaginary or of preferential folding, and the back, at least adjacent the side edges thereof, extends substantially to that line.

15. An article of stationery as claimed in claim 1, wherein the face and back of each envelope are not secured together in a region along their side edges whereby to permit air entrapped in each envelope in passing through a mechanism to escape.

16. An article of stationery as claimed in claim 1, wherein the face and back of each envelope are bonded together inboard of said side edges.

17. An article of stationery as claimed in claim 1, wherein the envelopes have side edges extending from the sides of one of the front and the back which are folded inwardly and secured to the other of the front and the back whereby to close the sides of the envelopes.

18. An article of stationery as claimed in claim 1, wherein said front side edges are continuous along the whole length of said article of stationery.

19. An article of stationery as claimed in claim 18, wherein said front side edges comprises regions wherein said length of material is overlapped on itself.

20. An article of stationery as claimed in claim 13, and in fanfold form.

21. An article of stationery as claimed in claim 20, including lines of perferential folding in certain ones of said envelopes to facilitate said fan folding.

22. An article of stationery as claimed in claim 21, wherein the first tab is attached to the face of each envelope about a line of preferential folding and said article of stationery is adapted to fanfold at that line.

23. An article of stationery as claimed in claim 18, wherein in the regions of said article of stationery in which part of one envelope overlaps part of another, adjacent, envelope the side edges of, respectively, the overlapping envelope or the overlapped envelope in way of the sprocket holes therein extend relatively more laterally than, respectively, the side edges of the overlapped envelope or the overlapping whereby, in use, a sprocket feed mechanism will engage with sprocket holes in the parts of the side edges which extend relatively more laterally and not with, respectively, the side edges of the overlapped envelope or the overlapping envelope.

24. An article of stationery as claimed in claim 13, wherein the first tab is attached to the back of an adjacent envelope per the continuity of said length.

25. An article of stationery as claimed in claim 13, wherein the first tab is attached to an adjacent envelope per the continuity of said length via a removable position.

26. An article of stationery comprising a continuous length of paper or other material suitable for envelope formation folded to define a plurality of envelopes wherein each envelope, excepting that one at one end of the length, partly overlaps and is attached, per the continuity of said length, to a first adjacent envelope and, excepting that one at the other end of the length, is partly overlapped by and is attached, per the continuity of said length, to another, second, adjacent envelope and wherein each envelope comprises a face and a back, and wherein at least substantially the whole of the face of each envelope is not overlapped by an adjacent envelope, wherein attached to the face of each envelope, per the continuity of said length, is a first tab adapted to be folded to the rear of the envelope to seal the envelope, and wherein attached to the back of each envelope, per the continuity of said length, is a second tab over or under which the first tab may be folded to seal the envelope, wherein adjacent envelopes are attached to one another per the continuity of said length through the first tab of one envelope being attached and contiguous to the second tab of an adjacent envelope and wherein the second tab is folded to overlie the back of the envelope and is secured to the back of the envelope in such overlying the back of the envelope condition.

27. An article of stationery as claimed in claim 25, wherein one or both of the first tab and the second tab is provided with an adhesive for sealing the envelope.

28. An article of stationery as claimed in claim 26, wherein the length of the first tab and the length of the second tab are such that at least substantially the whole of the face of each envelope is not overlapped by an adjacent envelope.

29. An article of stationery as claimed in claim 25, wherein the length of the first tab and the length of the second tab are such that the whole of the face of each envelope is not overlapped by an adjacent envelope.

30. An article of stationery as claimed in claim 26, wherein the sum of twice the length of the first tab and the length of the second tab, is not less than the length of the face of the envelope.

31. An article of stationery as claimed in claim 26 wherein the sum of twice the length of the first tab and the length of the second tab, is not greater than the length of the face of the envelope plus not more than 10 mm.

32. An article of stationery as claimed in claim 26, wherein the length of the first tab and the length of the second tab is such that, when the first tab is folded to seal the envelope, the first tab overlies and wholly covers the second tab.

33. An article of stationery as claimed in claim 25, wherein the attachment of the first tab of one envelope to the second tab of an adjacent envelope is via a line of preferential tearing along which the envelopes may be separated.

34. An article of stationery as claimed in claim 26, wherein the second tab of each envelope is folded to overlie the back of the envelope.

35. An article of stationery as claimed in claim 34, wherein the second tab is unfoldable from that position overlying the back whereby the first tab may be folded to overlie or underlie the second tab to seal the envelope.

36. An article of stationery as claimed in claim 26, wherein the second tab is detachably secured to the back of the envelope in such overlying the back of the envelope condition by an adhesive from which securement the second tab is capable of being de-adhered.

37. An article of stationery as claimed in claim 26, wherein the second tab is secured to the back of the envelope in such overlying the back of the envelope condition by an adhesive from which the second tab is incapable of being de-adhered without substantial likelihood of tearing of said paper or other material suitable for envelope formation.

38. An article of stationery as claimed in claim 37, wherein the length of the first tab and the length of the second tab is such that, when the first tab is folded to seal the envelope, the first tab overlies and wholly covers the second tab.

39. An article of stationery as claimed in claim 26, wherein the first tab is joined to the face via a line, real, imaginary or of preferential folding, and the back, at least adjacent the side edges thereof, extends substantially to that line and wherein the second tab is folded to overlie the back along a fold and wherein said fold line is relatively more adjacent the bottom of the envelope than those regions of the back adjacent the side edges thereof which are most proximate to that line between the first tab and the face.

40. An article of stationery as claimed in claim 26, wherein the second tab or an extension thereof is connected to the side edges of the respective envelope so as to cause folding of those side edges to overlap the back when the second tab is unfolded as aforesaid.

41. An article of stationery as claimed in claim 40, wherein lines of preferential folding are provided spaced from side edges and in the second tab or said extension to facilitate such folding of the side edges.

42. An article of stationery as claimed in claim 40, wherein one of said back and said side edges is provided with an adhesive adapted to retain said side edges in such folded condition.

43. An article of stationery comprising a continuous length of paper or other material suitable for envelope formation folded to define a plurality of envelopes wherein each envelope, excepting that one at one end of the length, partly overlaps and is attached, per the continuity of said length, to a first adjacent envelope and, excepting that one at the other end of the length, is partly overlapped by and is attached, per the continuity of said length, to another, second, adjacent envelope and wherein each envelope comprises a face and a back and wherein at least substantially the whole of the face of each envelope is not overlapped by an adjacent envelope, attached to the face of each envelope, per the continuity of said length, is a first tab adaped to be folded to the rear of the envelope to seal the envelope, and, wherein attached to the back of each envelope, per the continuity of said length, is a second tab over or under which the first tab may be folded to seal the envelope and wherein adjacent envelopes are attached to one another per the continuity of said length through the first tab of one envelope being attached and contiguous to a removable portion intermediate, in the continuity of said length, the first tab and the second tab of an adjacent envelope.

44. An article of stationery as claimed in claim 43, wherein said removable portion is defined by lines of preferential tearing at intersections with the first tab and the second tab.

45. An article of stationery comprising a continuous length of paper or other material suitable for envelope formation folded to define a plurality of envelopes wherein each envelope, excepting that one at one end of the length, partly overlaps and is attached, per the continuity of said length, to a first adjacent envelope and, excepting that one at the other end of the length, is partly overlapped by and is attached, per the continuity of said length, to another, second, adjacent envelope and wherein each envelope comprises a face and a back and wherein at least substantially the whole of the face of each envelope is not overlapped by an adjacent envelope, wherein said article of stationery has side edges provided with first and second sets of sprocket holes for use with sprocket feed printers, said second set of sprocket holes being outboard of said first set of sprocket holes.

46. An article of stationery as claimed in claim 45, wherein said second set of sprocket holes is spaced from the first mentioned sprocket holes by a region having a line of preferential tearing whereby that part of the side edges having said second set of sprocket holes may be stripped from the envelopes.

* * * * *